US005659080A

United States Patent [19]

Suzuki et al.

[11] Patent Number: 5,659,080

[45] Date of Patent: Aug. 19, 1997

[54] SYNTHETIC METHOD FOR FORMING AMMONIUM DINITRAMMIDE (ADN)

[75] Inventors: Shigeru Suzuki; Shigefumi Miyazaki, both of Saitama-ken; Hideo Hatano, Akigawa; Kazuo Shiino, Akigawa; Toshio Onda, Akigawa, all of Japan

[73] Assignees: Nissan Motor Co., Ltd., Kanagawa; Hosoya Fireworks Co., Ltd., Tokyo, both of Japan

[21] Appl. No.: 653,833

[22] Filed: May 28, 1996

[30] Foreign Application Priority Data

May 26, 1995 [JP] Japan ..... 7-152218

[51] Int. Cl.[6] ..... C07C 241/00

[52] U.S. Cl. ..... 564/109; 564/107; 423/385; 423/400

[58] Field of Search ..... 564/107, 109; 423/385, 400

[56] References Cited

U.S. PATENT DOCUMENTS 5,198,204 3/1993 Bottaro et al. ..... 423/385

5,254,324 10/1993 Bottaro et al. ..... 423/263

5,316,749 5/1994 Schmitt et al. ..... 423/385

5,415,852 5/1995 Schmitt et al. ..... 423/385

*Primary Examiner*—Shailendra Kumar

*Attorney, Agent, or Firm*—Sughrue, Mion, Zinn, Macpeak & Seas

[57] ABSTRACT

A synthetic method for ammonium dinitramide comprising a process for the formation of urea nitrate by reacting urea with diluted nitric acid; a process for the formation of nitrourea by reacting the urea nitrate with sulfuric acid; a process of reacting the nitrourea with a nitration reagent such as nitronium tetrafluoroborate, and then adding ammonia gas to the reaction mixture; and a process of filtering off the resultant by-product of crystals, concentrating its filtrate, adding ethyl acetate to this concentrated filtrate, filtering off the precipitate, concentrating again its filtrate under vacuum, and finally separating ADN as crystals by adding chloroform to the concentrated filtrate.

Effects:

ADN can be synthesized with the following features: urea as starting material is readily available and is cheaper in price, the process is uncomplicated and more simplified, the operation is safe, and the final product gives a high yield.

3 Claims, No Drawings

SYNTHETIC METHOD FOR FORMING AMMONIUM DINITRAMMIDE (ADN)

FIELD OF THE INVENTION

The present invention relates to a synthetic method for ADN useful as an oxidizer for composite solid propellant or as a high energetic material, and to describe more fully, relates to the one having the feature of using urea as starting substance.

BACKGROUND OF THE INVENTION

As an oxidizer for composite solid propellant, ammonium perchlorate (henceforth to be called AP) has been widely and generally used in the past because of its high performance. Although AP has been used for a long time and is one of the most popular oxidizers, it poses a problem for its use that it generates smoke as exhaust gas. Therefore, research workers of this country and outside have been endeavoring to find out oxidizers which do not pose any of the said problem and have the equal performance as AP. And one of these oxidizers is ADN. ADN is a compound consisting of nitrogen, hydrogen and oxygen, is clean as to exhaust gas and is a high energetic material. Hence, as a substitute of AP which is currently in use, it is the most suitable oxidizer to improve the performance of solid fuel rocket while harmonizing with environment. Having noticed its characteristics, the developed countries of America and Europe are actively engaging in the development of ADN. As to the development of ADN, Russia is more advanced than any other countries since the former Soviet Union. Although it has been reported that Russia has been producing ADN in the scale of several hundreds of tons, the details are entirely unknown. The United States of America has been also engaging in ADN research development with a combined effort of the government and private enterprise, and a part of the achievements has been disclosed through its patent applications.

It has been known to be the year of 1971 that potassium salt of dinitramide was synthesized. Since then there have been developed some prior arts on the method of forming dinitramide salts, especially ammonium salt (ADN).

First, there is the art of National Publication of Translated Version 5-500795(PCT/US91/04268). This is a method for nitrating nitramide. This reaction can be represented by the chemical equations of (I) and (II).

$$NH_2COOC_2H_5 \xrightarrow{NO2^+} NO_2NHCOOC_2H_5 \xrightarrow{NH_3} \quad (I)$$

$$NO_2N(NH_4)COOC_2H_5 \xrightarrow{KOH} NO_2NKCOO.K \xrightarrow{H_2SO_4} NO_2NH_2$$

$$NO_2NH_2 + NO_2BF_4 + 2NH_3 = (NO_2)_2NNH_4 + NH_4BF_4 \quad (II)$$

This method starts with forming nitrourethane by the nitration of urethane wherein the nitration reagent is ethyl nitrate, or fuming nitric acid in combination with acetic anhydride. Further, this product is reacted to form an ammonium salt and then form a potassium salt, and finally results in nitramide. This process of forming nitramide involves many steps and is complicated; moreover, potassium salt and nitramide are so unstable that they are not easy to handle; in addition to these, nitramide is produced with a very low yield based on the amount of the starting material, urethane; and further to obtain ADN nitramide is to be nitrated. Hence, it is not considered to be a suitable method for forming ADN.

Then, there is another prior art of W093/16002. This is a method based on the direct nitration of ammonium nitrourethane.

$$NO_2N(NH_4)COOC_2H_5 \xrightarrow{NO_2^+,\ NH_3} (NO_2)_2NNH_4 + NH_2COOC_2H_5 \quad (III)$$

This method may be called an improved type of the aforementioned National Publication of Translated Version 5-500795(PCT/US91/04268). That is, this is the method of forming ADN directly form ammonium nitrourethane ($NO_2NCOOC_2H_5.NH_4$), which is an intermediate product obtained in the process of the aforementioned National Publication of Translated Version 5-500795(PCT/US91/04268). It is regarded to be a more reasonable method since the object product is formed without isolating the unstable nitrourethane potassium salt ($NO_2NKCOO.K$) and nitramide ($NO_2NH_2$). However, this method still requires considerable steps to produce ammonium nitrourethane.

To resolve the above matter, another prior art of W091/19669 has been employed to obtain ADN by decomposing a special dinitramine with ammonia or other compound. This reaction can be represented by the following general chemical equation (IV).

$$L_nZR^-N(NO_2)_2 + MX \longrightarrow MN(NO_2)_2 + L_nZX + R \quad (IV)$$

where

L is the same or different 1–6 carbon alkyl, arlyl, hydrogen, halogen, or other group;

n is 1 to 3;

Z is an element of Si, Sn, Ge, As, B, Bi, Sb, Pb, or Hg;

$R^-$ is a 1 to 6 carbon alkylene group;

R is an alkyl group;

$M^+$ ion is either a metal cation, an ammonium cation, or a hydrazinium cation; and $^-X$ ion is an anion of either F, Cl, OH, $CO_3$, or COR.

An example of the above-mentioned dinitramine is $(CH_3)_3SiCH_2N(NO_2)_2$. However, in order to obtain this kind of dinitramine the reaction is to be carried out from the corresponding isocyanate as shown in the following chemical equation.

$$(CH_3)_3SiCH_2CNO \xrightarrow[HNO_3]{NO_2BF_4} (CH_3)_3SiCH_2CH_2N(NO_2)_2 \xrightarrow{(CH)_3F} (CH_3)_3HNN(NO_2)_2 \quad (V)$$

If the above reaction is employed, it is certain that the product will be very expensive. Even if the reaction is carried out by decomposing a comparatively simpler dinitramine of $L_nZR^-$, for example $CNCH_2CH_2N(NO_2)_2$, with ammonia, the synthetic process is still complicated.

SUMMARY OF THE INVENTION

It is, therefore, an object of this invention to establish a synthetic method of ADN with the following features: the starting material is readily available and is cheaper in price, the process is uncomplicated and more simplified, the operation is safe, and the final product gives a high yield.

And this object can be accomplished by the synthetic method for ADN stated in claim 1 comprising (a) a process for the formation of urea nitrate by reacting urea with diluted nitric acid;

(b) a process for the formation of nitrourea by reacting the urea nitrate with sulfuric acid;

(c) a process of reacting the nitrourea with a nitration reagent such as nitronium tetrafluoroborate, and then adding ammonia gas to the reaction mixture; and (d) a process of filtering off the resulting byproduct of crystals, concentrating its filtrate, adding ethyl acetate to this concentrated filtrate, filtering off the precipitate, concentrating again its filtrate under vacuum, and finally separating ADN as crystals by adding chloroform to the concentrated filtrate.

Further, this object can be preferably accomplished by the synthetic method stated in claim 2 having the feature that in the synthetic method stated in claim 1, the process of the aforementioned (c) is to suspend nitrourea in a solvent of acetonitrile, to react this suspension with a nitration agent under the condition of the reaction temperature from −30° C. to −65° C. and the reaction time from 1.5 hours to 3.5 hours while stirring, and to separate most of the by-product as crystals by adding ammonia gas to this reaction mixture.

Chemical Action:

The process from (a) to (d) of the method for forming ADN starting from urea stated in claim 1 can be represented by the following chemical equations.

$$NH_2CONH_2 \xrightarrow{HNO_3} NH_2CONH_2.HNO_3 \xrightarrow{H_2SO_4} NO_2NHCONH_2 \quad \text{(VI)}$$

When urea ($NH_2CONH_2$) is added to diluted nitric acid in small portions, immediately urea nitrate ($NH_2CONH_2.HNO_3$) is separated as white crystals, whose yield is nearly a theoretical amount. The crystals are filtered off and dried. The dried urea nitrate is then added to concentrated sulfuric acid to dissolve it while stirring. Then this solution is poured on crushed ice to separate nitrourea ($NO_2NHCONH_2$) as white crystals. The reaction is very simple and provides a good yield.

$$NO_2NHCONH_2+NO_2BF_4 \longrightarrow (NO_2)_2NCONH_2+HBF_4$$
$$(NO_2)_2NCONH_2+2NH_3 \longrightarrow (NO_2)_2N.NH_4+NH_2CONH_2 \quad \text{(VII)}$$

The nitrourea ($NO_2NHCONH_2$) is added to purified acetonitrile, followed by colling to −40° C., and followed by stirring vigorously to form a suspension. As this suspension is treated with a reagent $NO_2^+$, the suspended nitrourea is nearly dissolved. A clear solution results. This shows that further nitration is taking place to form dinitramide. The reagent $NO_2^+$ is selected from either nitronium tetrafluoroborate ($NO_2BF_4$) or nitric anhydride ($N_2O_5$). For this period of time the reaction is carried out under argon atmosphere lest the reaction solution should be exposed in the air.

The synthetic method of ADN starting from urea stated in claim 2 introduces ammonia gas to the solution after the above reaction with the reagent $NO_2^+$. Having been treated with ammonia gas, the reaction product is allowed to warm to room temperature and is recovered as the mother liquor by filtering off the byproduct of white crystals.

This byproduct of white crystals is washed with acetonitrile to further recover the reaction product remaining in the crystals. Then the washings and the mother liquor are mixed together and concentrated under vaccum at a temperature below 40° C. This concentrated solution is treated with ethly acetate and filtered off if any precipitate is formed. The solution is again concentrated, and is finally treated with dichloromethane, stirred and then allowed to stand still to obtain crude ADN, which has a slight yellow-brown color and a melting point of 87° C. This crude ADN is dissolved in a small quantity of acetonitrile and is treated with dichloromethane to acquire a precipitate, which is nearly colorless crystals with a melting point of 91° C.

EXAMPLE

Next, an example of this invention is to be described in detail. The present invention is in no way confined only to this example.

In a 100 ml beaker was placed a solution of 50 grams of 33% diluted nitric acid, and to this solution was added 14 grams of urea in small portions while stirring vigorously. For this period of time, since the temperature does not show any rise practically, this reaction can be carried out in room temperature and is not necessary to be kept cool. Immediately urea nitrate resulted as crystals. Having been allowed to stand for 10 minutes, the mixture was filtered to collect the crystals. This crystals were washed with a little amount of water to remove the solution well and were then dried in a desiccator under vacuum. The yield resulted in 23.8 grams of urea nitrate (97% yield), whose melting point was measured to be 162° C.

84 ml of concentrated sulfuric acid was placed in a 200 ml three-necked flask equipped with a thermometer and a stirrer, and was cooled to −3° C. To this acid was added and dissolved 23.8 grams of urea nitrate in small portions while stirring. Having been stirred for 30 minutes, the reaction mixture was poured on 150 grams of crushed ice. The resulted crystals were filtered, were washed with a little amount of water for twice, and were dried in a desiccator under vacuum. The yield resulted in 16.2 grams of nitrourea (72.4% yield), whose melting point was measured to be 159° C. Since nitrourea dissolves easily in water, its yield is improved more by taking sufficient care when washing with cold water.

The nitrourea was added to acetonitrile. The mixture was cooled, was suspended by stirring vigorously and was then treated with a nitration reagent, nitronium tetrafluoroborate ($NO_2BF_4$). In a short while, the solution became clear. After the reaction was maintained for a specified time, to this solution was added ammonia gas a little more than the calculated amount to precipitate the byproduct, which was then filtered off. The filtrate was concentrated under vacuum, was treated with ethyl acetate. If any precipitate is formed, it is to be filtered off. The filtrate was again concentrated under vacuum and was finally treated with chloroform to form ADN as crystals, which was then isolated. For the identification of ADN, Differential Scanning Calorimetry (henceforth to be called DSC) and the measurement of melting point were used. In Table 1, Reference 1–3 and Example 1–5 are shown.

TABLE 1

| | Reference | | | Example | | | | |
|---|---|---|---|---|---|---|---|---|
| | 1 | 2 | 3 | 1 | 2 | 3 | 4 | 5 |
| Nitrourea (g) | 1.5 | 1.2 | 1.5 | 3.8 | 5.0 | 4.0 | 3.1 | 3.8 |
| $CH_3CN$ (ml) | 50 | 50 | 50 | 125 | 160 | 100 | 100 | 80 |
| $NO_2BF_4$ (g) | 2.4 | 4.0 | 2.4 | 7.7 | 8.5 | 7.8 | 5.1 | 6.1 |
| Reaction (°C.) temperature | −10 | −10 | −20 | −40 | −40 | −65 | −40 | −30 |
| Reaction time (hr) | 0.3 | 1.5 | 1.5 | 1.5 | 1.5 | 1.5 | 0.5 | 3.5 |
| ADN amount (g) | 0.05 | — | 0.06 | 0.48 | 0.94 | 0.25 | 0.47 | 1.00 |
| ADN yield (%) | — | — | — | 10.6 | 16.0 | 5.0 | 10.0 | 20.0 |

In Reference 1–3 of Table 1, the formation of ADN was not confirmed. The cause was speculated that the amount of the starting material was not sufficient, those who tried to form ADN were inexperienced in the operation, and further the reaction temperature was high. Therefore, in Example 1–5 each reaction was carried out with a batch of the starting material increased by 2 to 2.5 times of the Reference, and with the reaction temperature decreased between −30° C. and −65° C. Though not shown in Table 1, the acetonitrile ($CH_3CN$) in Example 3 was mixed with 30 ml of dichloromethane ($CH_2Cl_2$) for use in the process.

In Example 1 and 2 the reaction was carried out at the reaction temperature of −40° C., and ADN yield was respectively 10.6% and 16.0%. Since they were not necessarily satisfying for ADN yields, in Example 3 the reaction was was carried out by decreasing the reaction temperature to −65° C. in order to increase the yield of ADN. As the solvent of acetonitrile has the freezing point of near −65° C., 100 ml of acetonitrile was mixed with 30 ml of dichloromethane to lower its freezing point so that the reaction could be carried out with the reaction temperature of −65° C.

Nitro urea is a compound to have been known from of old. ADN is prepared even if ammonium salt of nitrourea is reacted with nitronium tetrafluoroborate ($NO_2BF_4$). Nitrourea is first dissolved in the solvent of acetonitrile, methanol, benzene, dimethylformamide (DMF) or ethly acetate. While keeping cool, the mixture is introduced with an excess of ammonia gas to form ammonium salt. Whether the resulting crystals are the object product ammonium salt or not is determined by its melting point, DSC, infrared spectroscopy analysis and elementary analysis. This reaction is represented by the following chemical equations (VIII) and (IX).

$$NH_2CONH_2 \xrightarrow{HNO_3} NH_2CONH_2.HNO_3 \xrightarrow{H_2SO_4} \quad \text{(VIII)}$$

$$NO_2NHCONH_2 \xrightarrow{NH_3} NO_2N(NH_4)CONH_2$$

Ammonium salt ($NO_2N(NH_4)CONH_2$) of nitrourea is first added to purified acetonitrile, followed by cooling to −40° C., and followed by stirring vigorously to form a suspension. When this suspension is treated with a reagent $NO_2^+$, the suspended ammonium salt of nitrourea is nearly dissolved. The solution becomes clear. This shows that further nitration is taking place to form dinitramide. The reagent $NO_2^+$ is selected from either nitronium tetrafluoroborate ($NO_2BF_4$) or nitric anhydride ($N_2O_5$). For this period of time the reaction is carried out under argon atmosphere lest the reaction solution should be exposed in the air.

$$NO_2N(NH_4)CONH_2+NO_2BF_4 \longrightarrow (NO_2)_2NCONH_2+NH_4BF_2$$
$$(NO_2)_2NCONH_2+2NH_3 \longrightarrow (NO_2)_2N.NH_4+NH_2CONH_2 \quad \text{(IX)}$$

Ammonium salt ($NO_2N(NH_4)CONH_2$) of nitrourea is first added to purified acetonitrile, followed by cooling to −40° C., and followed by stirring vigorously to form a suspension. When this suspension is treated with a reagent $NO_2^+$, the suspended ammonium salt of nitrourea is nearly dissolved. The solution becomes clear. This shows that further nitration is taking place to form dinitramide. The reagent $NO_2^+$ is selected from either nitronium tetrafluoroborate ($NO_2BF_4$) or nitric anhydride ($N_2O_5$). For this period of time the reaction is carried out under argon atmosphere lest the reaction solution should be exposed in the air. Then the reaction solution is introduced with ammonia gas and followed by filtering off the byproduct of white crystals. After the mother liquor is concentrated under vacuum at a temperature below 40° C., the concentrated liquor is treated with ethyl acetate. If any precipitate is formed, it is to be filtered off. The solution is again concentrated, and finally treated with dichloromethane, stirred and allowed to stand to acquire crude ADN. This is the same process as that starting with nitrourea.

The reaction of nitrourea with nitric anhydride ($NO_2.NO_3$) is represented by the following chemical equation (X).

$$NO_2NHCONH_2+NO_2NO_3 \longrightarrow (NO_2)_2NCONH_2+HNO_3$$
$$(NO_2)_2NCONH_2+NH_3 \longrightarrow (NO_2)_2N.NH_4+NH_2CONHN_2 \quad \text{(X)}$$

Nitric anhydride ($NO_2.NO_3$) is dissolved in 40 ml of dried dichloromethane, followed by adding 15 ml of acetonitrile ($CH_3CN$), followed by cooling this solution to −40° C., and followed by adding 4grams of nitrourea while stirring. After being continuously stirred for 20 to 60 minutes, the mixture is treated with an excess of ammonia gas. Then the reaction mixture is concentrated to approximately 15 ml under vacuum, and to this mixture is added 25 ml of acetonitrile and 25 ml of ethyl acetate. After being stirred for 5 minutes, the solution is filtered. The impurities are washed off with a little amount of ethyl acetate. Its washings and the above filtrate are mixed together, concentrated to 7–8 ml, and then treated with 50 ml of chloroform or dichloromethane to form ADN crystals.

Effects of the Invention:

As explained above, according to the present invention, ADN can be synthesized with the following features: urea as starting material is readily available and is cheaper in price, the process is uncomplicated and more simplified, the operation is safe, and the final product gives a high yield.

What is claimed is:

1. A synthetic method for ammonium dinitramide (henceforth to be called ADN) comprising (a) forming urea nitrate by reacting urea with diluted nitric acid;

(b) forming nitrourea by reacting the urea nitrate with sulfuric acid;

(c) reacting the nitrourea with a nitration reagent and then adding ammonia gas to the reaction mixture; and (d) filtering off the resulting by-product of crystals, concentrating its filtrate, adding ethyl acetate to this concentrated filtrate, filtering off its precipitate, concentrating again its filtrate under vaccum, and finally separating ADN as crystals by adding chloroform to the concentrated filtrate.

2. A synthetic method as in claim 1, wherein (c) comprises suspending nitrourea in acetonitrile, reacting this suspension with a nitration agent under the conditions of a reaction temperature from −30° C. to −65° C. and a reaction time from 1.5 hours to 3.5 hours while stirring, and separating most of the by-product as crystals by adding ammonia gas to this reaction mixture.

3. The synthetic method as in claim 1, wherein said nitration agent in (c) is nitronium tetrafluoroborate.

* * * * *